United States Patent [19]

Melzer

[11] 3,972,519

[45] Aug. 3, 1976

[54] APPARATUS FOR THE ZIG-ZAG FOLDING OF A WEB OF MATERIAL

[75] Inventor: Roland Melzer, Schwelm, Germany

[73] Assignee: R. Melzer oHG Machinenbau und Metallverarbeitung, Schwelm, Germany

[22] Filed: Jan. 17, 1975

[21] Appl. No.: 541,927

[30] Foreign Application Priority Data

Jan. 17, 1974 Germany ..... 2402027

[52] U.S. Cl. ..... 270/30; 270/61 F; 270/79; 226/118

[51] Int. Cl.[2] ..... B65H 29/46

[58] Field of Search ..... 270/30–31, 270/61 F, 79; 226/118–119

[56] References Cited

UNITED STATES PATENTS

| | | | |
|---|---|---|---|
| 2,902,888 | 9/1959 | Powischill | 270/31 |
| 3,627,306 | 12/1971 | Affupper | 270/79 |
| 3,697,062 | 10/1972 | Mones | 270/30 |
| 3,871,763 | 3/1975 | Schrempp | 270/61 F |

FOREIGN PATENTS OR APPLICATIONS

| | | | |
|---|---|---|---|
| 181,590 | 9/1954 | Austria | 270/30 |

*Primary Examiner*—E. H. Eickholt
*Assistant Examiner*—A. Heinz
*Attorney, Agent, or Firm*—James R. Haller; H. Dale Palmatier

[57] ABSTRACT

Apparatus and method of producing a Leporello folding of a web of material including a pair of rollers driven by unidirectional drive devices and continually revolved in a same direction and directing the web of material upwardly between the nip of the rollers, a pair of belt conveyors receiving the web of material, the conveyor belts travelling in the same direction, and reversing frequently to carry the web first in one horizontal direction and then in the opposite horizontal direction, a receptacle receiving the web folded on the conveyor belts and containing a weight for maintaining pressure between the web and the conveyors and a drive apparatus continually driving the rollers slightly slower than the conveyor belts.

5 Claims, 1 Drawing Figure

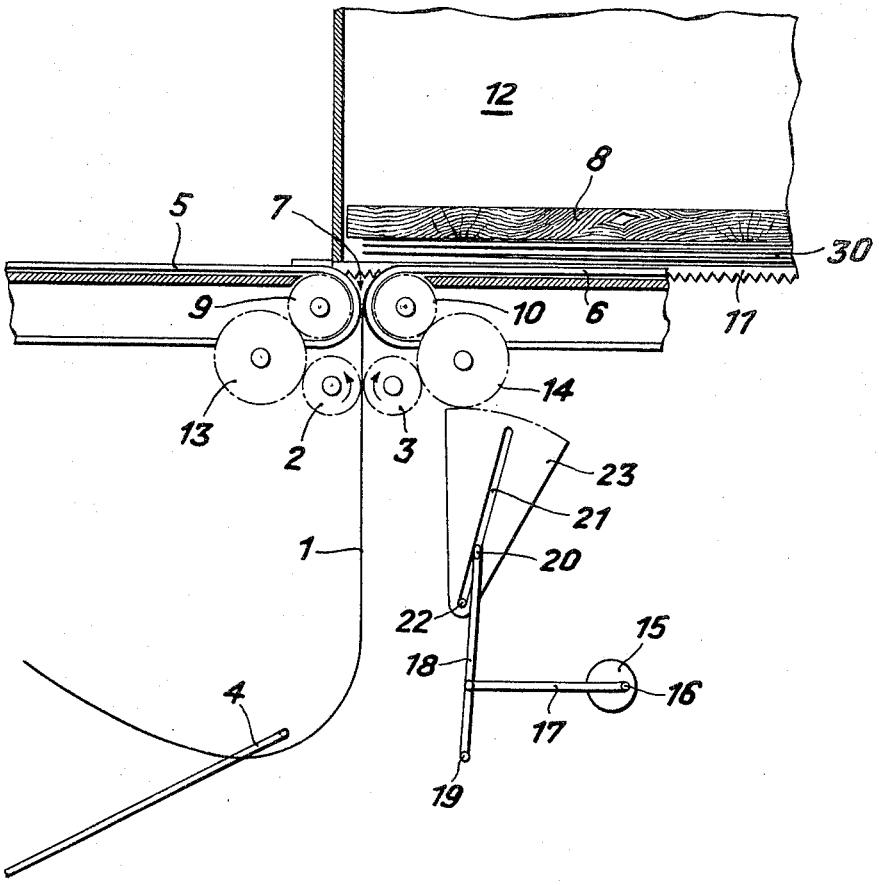
12
8
5
7
30
9
10
6
11
13
2
3
14
23
21
1
20
22
15
18
16
4
17
19

APPARATUS FOR THE ZIG-ZAG FOLDING OF A WEB OF MATERIAL

The invention relates to an apparatus for the zig-zag folding of a web of material sometimes referred to as Leporello folding. Such devices form into a stack endless forms, travel or entrance tickets, labels and the like, from which they are easily removable, without great expenditure of energy, and can, for example, by separated individually or read mechanically.

The web often already has fold-lines which must be kept to very accurately when folding. Instead, the web may be smooth and the format may be determined by the folding. Instead, the web may have weak positions — such as lateral incisions at which the folding is to occur. The most difficult situation is the one where the web has weak positions, but is not, however, to be folded at these positions, but rather near or between them.

The invention provides apparatus for the zig-zag folding of a web of material comprising a pair of endless transverse conveyor means arranged at the same level as each other, extending in opposite directions, and spaced apart to receive the web therebetween, and means for feeding the web between the conveyor means, wherein, in operation, pressure is applied to the emerging web in a direction towards the conveyor means, and the conveyor means travel in the same direction as each other and are repeatedly reversed in direction, whereby a zig-zag folded stack is produced.

Such apparatus can be used for all the forms of web referred to hereinbefore.

The apparatus works in the following way. The feeding means, which may be a pair of rollers in frictional engagement with the web, feeds the web through the entrance nip between the two transverse conveyor means. It is then subject to the applied pressure and is directed sideways by the transverse movement of the transverse conveyor means, held between the means applying the pressure and one of the transverse conveyor means. On reversal of the direction of movement of the two conveyor means, the part of the web pressed against the conveyor means now moves in the opposite direction, and the front section of the web tends to be pushed back into the entrance region. As, however, further web material is being pushed on by the feeding means, a form of loop is produced, which is moved towards the other transverse conveyor means, and is folded and "ironed flat" on being pressed against the conveyor means. On the next reversal of the direction of the conveyor means, the same process takes place. In accordance with this a stack is built against the transverse conveyor means, in which the desired Leporello folding can be seen. The apparatus may be arranged to fold the web into identical formats. When the stack is of a sufficient height, the stack itself may serve to provide the applied pressure if the arrangement of the apparatus is suitable, for example, if the feeding means transmit vertically upwards; in a spatially different arrangement the pressure can be provided by springs or transferred by means of lever rods. An even weight may be used to provide the applied pressure; the weight may be adjusted in size to, or the same size as, the format of the folded web. Such a weight can follow the pile in its folding movements.

The conveyor means may each include conveyor belts.

The speed of the feeding means and of the conveyor means will be adjusted relative to each other; however, the webs speed of both is, preferably, not exactly the same. For, since it cannot be assumed that a web provided with fold-lines will be handled with absolutely faithful repetition, and since even with continuous adjustment of the stroke of the conveyor means, the stroke will never correspond completely accurately to the division of the fold-lines, an excessively long or short measure may be produced, which after some ten or hundred operations will accumulate so far that the folding will occur next to the fold-line. In this case, that is, when fold or weakened lines are to be considered, the stroke of the conveyor means is given a small increase, but the supply rollers are driven with a somewhat lower rotational speed, however via a free-wheel device. The stack forms nevertheless according to the fold-lines because the excess stroke is very small. After some time in operation, an excess stroke which has mounted up somewhat evens itself out due to the fact that the stack produces a sliding movement along the conveyor means, simply because of the longitudinal stiffness of the material. The stiffer the web of material, the more effective is this self-regulation; with very "limp" material a correspondingly careful adjustment of the increase to a still lower value is required. An apparatus so constructed is however also in the position to arrange correctly a web of material which does not have fold-lines, into a Leporello pile.

Apparatus for the zig-zag folding of a web of material, constructed in accordance with the invention, will now be described, by way of example, with reference to the accompanying drawing, which shows a side view of the apparatus.

A web 1 runs from below into the nip between the feeding (or conveyor) rollers 2 and 3. As the apparatus is an independent unit with its own drive, its operating speed must be matched to the delivery speed of a web processing machine (not shown in the diagram), connected in series; therefore a feel-lever 4 is provided which, when the apparatus is operating too quickly is deflected from the web 1 and thus switches off the apparatus, until the machine, which is connected in series, has once more produced a sufficient length of web.

The conveyor 2, 3 rollers which revolve oppositely of each other, as shown by the arrows, push the web upwards and in between the two transverse conveyor belts, 5 and 6. The conveyor belts are spaced apart at the nip by a distance greater than the thickness of the web of material. The feeding rollers 2, 3 have conveying or surface speeds which are less than the travelling speeds of the conveyor belts 5, 6.

After the web is fed through the entry nip 7 of the transverse conveyor belts, pressure is applied to the emerging web in a direction towards the conveyor belts by means of an even weight 8, here simply a piece of wood, so that the free end of the web is transversely deflected. It may now be assumed that the transverse conveyor belt 6 is so driven, in a manner yet to be described, that its upper track runs to the right as seen in the drawing. Then the end of the web is sandwiched between the piece of wood 8 and the belt 6 and runs likewise to the right, wherein the piece of wood 8 goes freely along with it. Also the conveyor belt 5 runs with the same belt speed in the same direction. This is effected by cog wheels 9 and 10 disposed on guide drums of the transverse conveyor belts 5, 6, which cog wheels are shown here, only by broken lines, as rollers. The cog wheel pair 9 and 10, as well as similar cog wheels on the guide drums (not shown) at the other ends of the belts are engaged with racks 11 on both sides of the belts and above these. The racks are fitted with a receptacle 12 for the stack 30 being formed, which could otherwise topple over, as in fact it travels constantly to and fro with the racks.

Upon the reversal of the direction of movement of the belts, the folding operation takes place as described above, the piece of wood 8 being slightly raised. When the stack is high enough and also heavy enough, the piece of wood 8 can even be removed, as the stack itself then acts as a weight.

The conveyor rollers 2 and 3 are held under tension by a spring or the like (not shown) in frictional contact with the web 1; furthermore they may have slip-reducing surfaces, such as milled surfaces. The drive of the conveyor rollers is effected by the cog wheels 9 and 10 via cog wheels 13 and 14 inserted in between to reverse the rotational direction.

Cog wheel 9 consequently drives roller 2 and cog wheel 10, roller 3. As however the cog wheels 9 and 10 run in the same direction because of the coupling via the rack 11, then in each case one of the two conveyor rollers would run in the wrong direction. For this reason ratchet couplings or unidirectional driving devices are fitted between the cog wheels on the conveyor rollers and the roller bodies themselves; these couplings or devices are not shown in the diagram and allow the drive of the rollers only in the direction of conveying marked by the arrows. The roller which is being driven in the "correct" direction at the time therefore drives the roller-body of the other through the frictional coupling and optionally also a further cog against the rotational-drive, which is transmitted to each of the guide-drum cog-wheels concerned.

It is desirable, that the reversal of movement at the end-positions of the stack be relatively slow. However, to make the operating speed of the device relatively high on the whole, the stroke between the end-positions should be run through as quickly as possible. Therefore a double-action crank mechanism is provided for the drive.

The continuously turning shaft 15 carries a crank 16, which is coupled by a crank-rod 17 with a pivotable lever 18. The latter is hinged at 19 and at its free end is fitted with a thrust-member 20, which can slide along in a groove 21 of a disc-sector 23 hinged at 22. Sector 23 is cogged on the outer edge and the cogged edge meshes, for example, as shown, with cog wheel 14. The fold-format is adjusted simply by displacing the pivot-point of lever 18 on the rack (not shown) on the one hand, and of crank-rod 17 on the lever 18 on the other hand; by displacement of the thrust member along the length of the lever a further fine adjustment can be undertaken, if the measurements are suitably chosen.

It can be seen, that the end-position sector 23 and thus also of the stack will traverse near the dead centre of crank 16, and that through the push-crank gearing from lever 18 and sector 23 a further delay in the end-positions is produced.

It is obvious to the technician, that other forms of transmission of the drive force can be suitable, such as link quadrilaterals or something similar. It can furthermore be seen that the relative movement between the rack 11 with the container 12 on the one hand, and the transverse conveyor belts and the supply rollers on the other hand, can also be reversed, that is, so that the container with the rack is fixed while the remainder of the apparatus is arranged on a sliding guide for to and fro movement.

Finally it is possible, in certain cases, to replace the transverse conveyor belts by equivalent means, such as drums, if, for example, the fold-format is extremely short.

What is claimed is:

1. Web folding apparatus for producing a zig-zag folded stack, comprising: a pair of adjacent endless transverse web conveyor means for conveying a web and having adjoining and spaced web-receiving portions for receiving a web therebetween and each including a rotatable drum for driving a conveyor means, said pair of conveyor means being oriented to respectively and alternately convey the web in opposite directions from said adjoining portions; feeding means to feed the web between the adjoining portions of said pair of conveyor means; pressure applying means pressing the web against said conveyor means; driving means including cog wheels each connected in driving relation with a respective drum to rotate the drums in the same direction and at the same speed as each other to drive said pair of conveyor means in the same speed and direction as each other and repeatedly reversing said direction of both said conveyor means; a rack meshing with the cog wheels to coordinate the speed and direction of revolution of the drums; and a receptacle for the folded stack and secured to the rack for movement to and fro therewith as the cog wheels revolve; whereby a zig-zag folded stack is produced.

2. Apparatus according to claim 1, wherein said feeding means comprises a pair of conveyor rollers to feed the web without interruption and continuously in the same direction.

3. Apparatus according to claim 1, wherein said feeding means comprises a pair of conveyor rollers, and said driving means including unidirectional driving devices drivably connected with the rollers for driving each of said rollers in only one direction, said devices driving said rollers in opposite directions relative to each other.

4. Web folding apparatus comprising: a pair of adjacent endless transverse web conveyor belts having adjoining but spaced ends for receiving a web therebetween and being oriented to respectively convey the web in opposite directions from said adjoining ends; feeding means to feed the web between ends; pressure-applying means pressing the web against said conveyor belts; driving means including driving drums driving the conveyor belt and cog wheels in driving relation with the drums and driving said pair of conveyor belts at the same speed and direction of revolution as each other and repeatedly reversing said direction of revolution; a rack meshing with the cog wheels and a receptacle to receive a folded stack and secured to the rack for movement to and fro therewith as the direction of rotation of the conveyor belt is repeatedly reversed; and said driving means also including a crank-gear driving at least one cog wheel, whereby said apparatus can be driven via said crank-gear by a continuously rotating shaft.

5. Apparatus according to claim 4, wherein said crank gear is a double-action, oscillating crank gear of adjustable amplitude.

* * * * *

UNITED STATES PATENT OFFICE

CERTIFICATE OF CORRECTION

Patent No. 3,972,519 Dated August 3, 1976

Inventor(s) Roland Melzer

It is certified that error appears in the above-identified patent and that said Letters Patent are hereby corrected as shown below:

In claim 4, line 50, after "between", insert --said adjoining--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*